United States Patent [19]

Stoltefuss

[11] 4,437,708

[45] Mar. 20, 1984

[54] CUTTING DEVICES FOR MINING AND TUNNELLING MACHINES

[75] Inventor: Wilhelm Stoltefuss, Kamen-Heeren-Werve, Fed. Rep. of Germany

[73] Assignee: Gewerkschaft Eisenhutte Westfalia, Lunen, Fed. Rep. of Germany

[21] Appl. No.: 404,734

[22] Filed: Aug. 3, 1982

[30] Foreign Application Priority Data

Aug. 27, 1981 [DE] Fed. Rep. of Germany ..... 3133956

[51] Int. Cl.[3] ..... E21C 35/22

[52] U.S. Cl. ..... 299/81; 299/12; 299/17; 175/339; 175/393; 239/587; 239/557; 239/559

[58] Field of Search ..... 299/81, 17, 12; 175/339, 340, 393; 239/587, 557, 558, 559

[56] References Cited

U.S. PATENT DOCUMENTS

| | | | |
|---|---|---|---|
| 2,693,950 | 11/1954 | Calder | 299/81 |
| 3,374,033 | 3/1968 | Arentzen | 299/81 |
| 4,174,759 | 11/1979 | Arbuckle | 175/393 |
| 4,186,971 | 2/1980 | Gebetsroither et al. | 299/12 |
| 4,296,824 | 10/1981 | Kennington | 175/340 |
| 4,375,242 | 3/1983 | Galle | 175/339 |

FOREIGN PATENT DOCUMENTS 2016558 9/1979 United Kingdom .

*Primary Examiner*—Ernest R. Purser
*Assistant Examiner*—Mark J. Del Signore
*Attorney, Agent, or Firm*—Sughrue, Mion, Zinn, Macpeak and Seas

[57] ABSTRACT

A cutting device for a mining or tunnelling machine takes the form of a roller with cutter bits which rotates at the end of a movable arm as is known. Grooves in the roller receive plate-like components which support water spray nozzles radially within the extremities of the cutter bits. The support components are stationary but are adjustable about the axis of rotation of the roller to bring the nozzles into the appropriate location during operation.

9 Claims, 4 Drawing Figures

CUTTING DEVICES FOR MINING AND TUNNELLING MACHINES

BACKGROUND OF THE INVENTION

The present invention relates to cutting devices incorporating water spray nozzles for use with mining or tunnelling machines.

In order to drive tunnels, galleries and the like and to win mineral ores it is know to use the so-called partial cutting machines which have a rotatable cutting device such as one or more rollers or drums at the end of a pivotable arm or jib. The cutting arm is able to swing from side-to-side and is raisable and lowerable. The machine itself carrying the arm is normally provided with tracks or wheels so it can be moved bodily. Water spray jets are useful in such devices to suppress dust, to cool the cutter bits and the work face and to inhibit $CH_4$ explosion in workings subjected to the danger of fire damp.

U.K. published application No. 2016558A describes a cutting device which incorporates both cutters and water spray nozzles.

A general object of the present invention is to provide an improved form of cutting device incorporating cutters and water spray nozzles.

SUMMARY OF THE INVENTION

The present invention provides a cutting device comprising, in combination, a rotatable roller equipped with cutters and a plurality of water spray nozzles. In accordance with the invention the nozzles are carried by support means which does not rotate with the roller.

The support means may take the form of narrow plate-like components fitted into spaced grooves in the roller. Each component then has several nozzles disposed arcuately around the axis of rotation and a channel or bore for conveying water thereto. The nozzles are positioned radially well within the tips of the cutters and are hence protected. Although the support components are fixed in relation to the rotatable roller it is desirable to permit these components to be adjusted around the axis of rotation to a limited extent and preferably in unison to bring the nozzles into a desired position which corresponds to that over which the cutters of the roller engage the work face.

Since the support means for the nozzles does not rotate with the roller problems encountered in conveying water through the roller itself and of sealing are avoided. The device is simple to construct yet operates reliably.

To facilitate assembly and dismantling of the nozzle support means it is desirable to make each plate-like component from parts which can be separated radially of the roller. To avoid unnecessary wear between the sliding surfaces of the support components and the roller, it is preferably to provide lubrication supply channels or bores in the components. Seals can effectively engage between the components and the flanks of the the grooves.

The support components can be interconnected by a strap or link or the like to partly rotate as a unitary assembly about the axis of rotation of the roller to bring the nozzles into the correct location. Means, such as a piston and cylinder unit, can serve to adjust the support components and such means can operate automatically as on arm or jib carrying the cutting device is raised or lowered.

A device constructed in accordance with the invention may also comprise a rotatable body provided with detachable cutter bits, water-spray nozzles extending arcuately of the body and radially within the extremities of the cutter bits and supports for the nozzles engaging in spaced grooves in the body wherein the supports and the body move relative to one another as the body rotates, the supports are adapted to supply water to the nozzles and the supports are adjustable about the axis of rotation to bring the nozzles into selected orientational positions.

The invention may be understood more readily, and various other aspects and features of the invention may become apparent, from consideration of the following description.

BRIEF DESCRIPTION OF DRAWINGS

Embodiments of the invention will now be described, by way of examples only, with reference to the accompanying drawings wherein.

DESCRIPTION OF PREFERRED EMBODIMENTS

Figure 1:
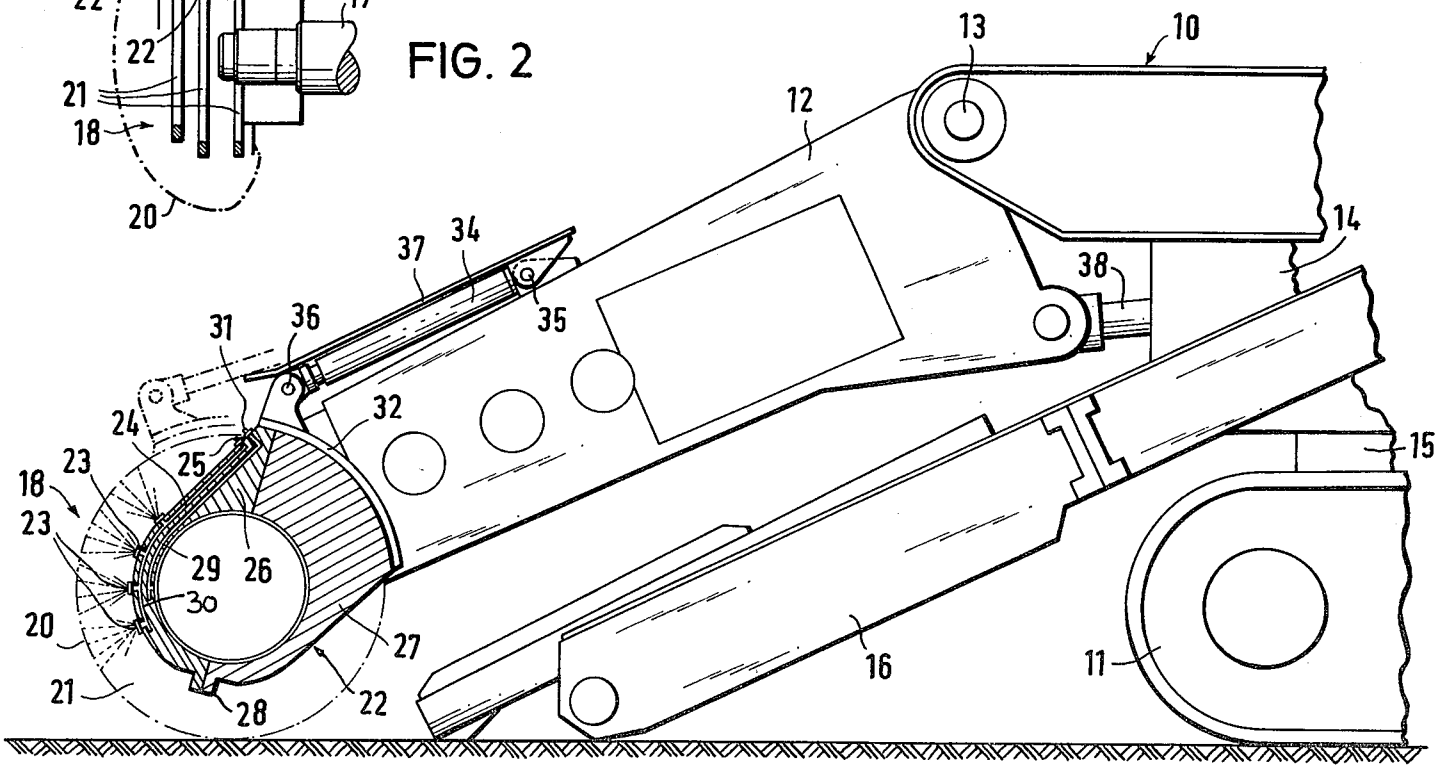
FIG. 1 is a schematic part-sectional side view of the front part of a machine constructed in accordance with the invention.

In general, FIG. 1 depicts a mining or tunnelling machine 10 which is rendered mobile by the provision of endless tracks 11 which engage on the floor. The machine has a cutting arm or jib 12 pivotably mounted for movement up and down by means of a pivot joint 13 coupled to a turntable 14. The turntable 14 can be rotated about a vertical axis in relation to a frame or chassis 15 of the machine which is supported by the tracks 11. Thus, as is known the arm can be raised or lowered or swung from side to side with the turntable 14. A loading device 16 is mounted to the frame 15 beneath the cutting arm 12. As is know, the device 16 serves to load and remove the debris or spoil or mineral ore detached during operation.

The arm 12 is provided at its free end with a cutting appliance which takes the form of two cutting drums or rollers 18. The cutting rollers 18 are driven by a common drive shaft 17 (FIG. 2) which extends perpendicularly to the arm 12. The drive system for the shaft 17 can be located within the arm 12. As is known, the rollers 18 are provided with detachable cutting tools such as conical cutter bits 19 shown in FIG. 4. The disposition of the points of the cutter bits 19 of one of the rollers 18 is denoted by the chain-dotted line 20 in FIGS. 1 and 2. For convenience, only one of the cutting rollers 18 is shown in the drawing and the cutter bits 19 themselves are omitted from FIGS. 1 to 3 for the sake of clarity.

Figure 2:
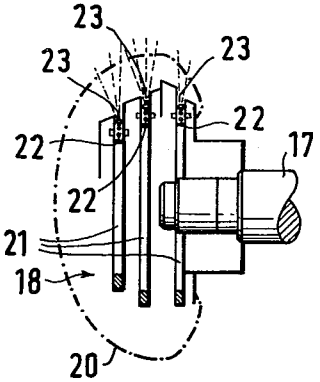
FIG. 2 is a schematic plan view of one of the cutting devices of the machine.

Each of the rollers 18 is provided with a plurality of grooves or recesses 21 spaced apart along the axis of the shaft 17. As shown in FIG. 2, some three grooves 21 can be provided on each roller 18. Each groove 21 receives a composite narrow plate-like component 22 which serves to support a number of nozzles 23. The nozzles 23 on each support component 22 are spaced apart circumferentially of the roller 18 and are positioned inside the extremities (20) of the cutter bits 19 for protection. The nozzles 23 supported on each component 22 communicate with a common water feed bore 24 which leads to a connector 25 on the component 22.

Figure 4:
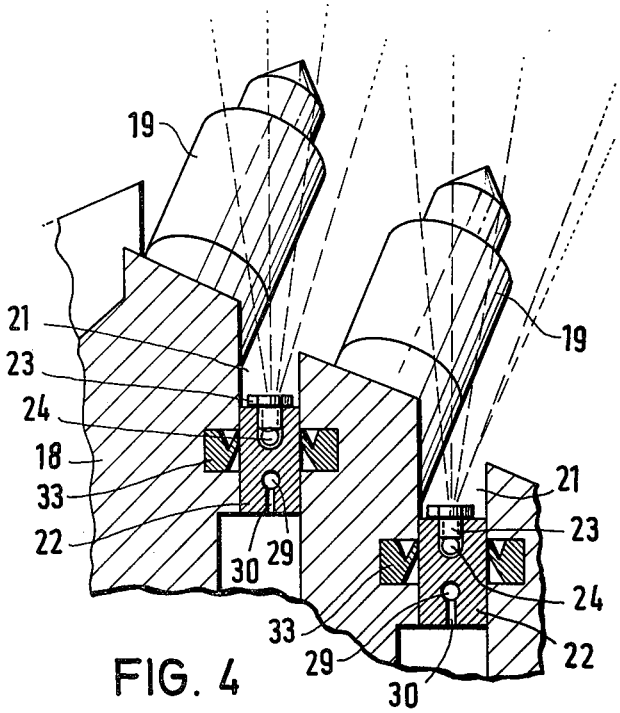
FIG. 4 is an enlarged part-sectional diagramatic illustration depicting the cutter bits and nozzles of one of the cutting devices of the machines.

Each nozzle support 22 is composed of two segmental parts 26, 27 which can be divided radially of the roller 18. The parts 26, 27 engage around the base of the associated groove 21 as shown in FIG. 1 and the parts 26, 27 have flanges 28 engaging one another. Fasteners can be fitted to the flanges 28 to detachably connect the parts 26, 27 together. The part 26 is provided with the nozzles 23 and with the water supply bore 24. In addition the part 26 has a lubrication bore 29 which as shown in FIG. 4 leads via a radial bore 30 from the base of the groove 21 to a further connector 31 disposed adjacent to the connector 25. FIG. 4 also shows how the supports 22 are sealed within the recesses 21 by means of resilient sealing devices 33. Water can be supplied to the connectors 25 thereby to cause water jets to emerge from the nozzles 23. Lubricant can be supplied by way of the connectors 31 in order to lubricate the sliding surfaces of the roller 18 and the parts 26, 27.

The individual supports 22 are connected together via an arcuate bridging plate 32 to form one pivoting assembly. The plate 32 extends over the rear upper zone of the roller 18.

During the cutting operation, the rollers 18 rotate in relation to the supports 22 and the nozzles 23 which are disposed over the sections of the rollers 18 which perform the cutting work emits jets of water as shown in FIGS. 1 and 4. These water jets impinge on the work face and spray the cutter bits 19. This ensures cooling of the cutter bits 19 and of the local working face and also aids dust supression.

It is apparent that as the arm 12 pivots about the joint 13 the rollers 18 engage the working face over different regions. In order to ensure that the water emitted by the nozzles 23 is in the correct location the bridging link plate 32 is shifted to move the linked supports 22 about the axis of the shaft 17. As shown in FIG. 1, to achieve this re-positioning, a hydraulic piston and cylinder unit 34 is connected to the arm 12 by way of a pivot joint 35 and by way of a further pivot joint 36 to the plate 32. The unit 34 lies in a protected position underneath a cover 37 which can conveniently be fitted to the pivot joint 35. It is also possible to connect hydraulically the unit 34 with the unit 38 which effects the pivotal motion of the arm 12. In this way the supports 22 and hence the nozzles 23 can be automatically positioned in the correct location whenever the arm 12 pivots about the joint 13. FIG. 1 shows the different positions adopted by the supports 22 with the piston and cylinder unit 34 retracted (full lines) and extended (chain-dotted lines). In this latter position, the bridge plate 32 extends over the top of the associated roller 18. This acts as a useful cover or guard when the machine is not operating and operators can use the plate 32 as a working platform.

Figure 3:
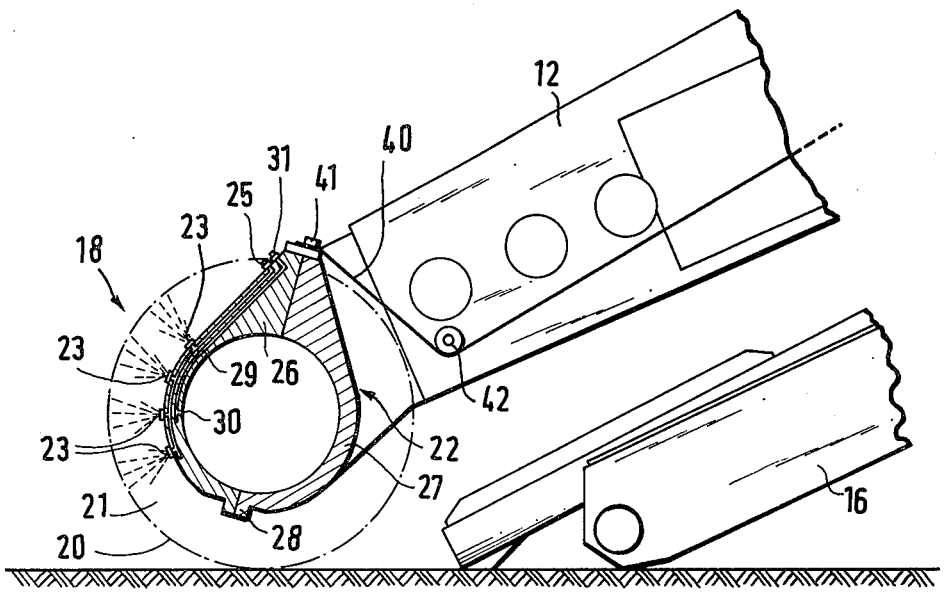
FIG. 3 is a view generally corresponding to FIG. 1 but depicting an alternative construction in accordance with the invention.

In the modified arrangement shown in FIG. 3, the mechanism for moving the linked supports 22 takes the form of a traction cable 40 connected at one end 41 to the supports 22 via the bridge plate 32 and passing over one or more pulleys 42 to some fixed point on the machine chassis or its superstructure. When the arm 12 is pivoted downwards the cable 40 is subjected to less tension and the holders 22 move anti-clockwise in relation to the rollers 18 under the effect of gravity. Conversely, when the arm 12 is raised the supports 22 are pivoted clockwise in relation to the rollers 18 as the cable 40 is tensioned.

I claim:

1. A cutting device comprising in combination, a rotatable roller equipped with cutters and a plurality of water spray nozzles carried by support means which does not rotate with the roller, wherein the support means comprises at least one narrow plate-like component fitted into a groove in the roller.

2. A device according to claim 1, wherein the support means is provided with at least one internal channel or bore for supplying water to the nozzles.

3. A device according to claim 1, wherein the support means comprises a number of narrow plate-like components fitted into spaced-apart grooves in the roller.

4. A device according to claim 3, wherein each component of the support means is composed of interconnected parts which can be separated radially of the roller.

5. A device according to claim 3, wherein the components are connected together for common limited positional adjustment around the axis of rotation of the roller.

6. A device according to claim 5, wherein means is provided to effect said adjustment by pivoting an assembly composed of the components and a bridging element connecting the components together.

7. A device according to claim 1, wherein an internal lubrication supply channel or bore is provided in said component to bring lubricant to sliding surfaces of the component and the groove.

8. A device according to claim 7, wherein the device is mounted at the end of a displaceable arm of a machine and said adjustment means operates in accordance with the motion of the arm in the vertical sense.

9. A cutting device comprising a body rotatable about an axis of rotation and provided with detachable cutter bits, water-spray nozzles extending arcuately of the body and radially within the extremities of the cutter bits and supports for the nozzles engaging in spaced grooves in the body wherein the supports and the body move relative to one another as the body rotates, the supports are adapted to supply water to the nozzles and the supports are adjustable about the axis of rotation to bring the nozzles into selected orientational positions.

* * * * *